US007497184B1

(12) United States Patent
Chaffin et al.

(10) Patent No.: US 7,497,184 B1
(45) Date of Patent: Mar. 3, 2009

(54) LOAD RELIEF MECHANISM FOR FISHING BOAT TOWER

(76) Inventors: Lucas James Chaffin, 403 Mississippi Ave., Ozona, FL (US) 34660; Jeffrey David Bush, 119 E. Cedar St., Tarpon Springs, FL (US) 34689

( * ) Notice: Subject to any disclaimer, the term of this patent is extended or adjusted under 35 U.S.C. 154(b) by 0 days.

(21) Appl. No.: 11/936,949

(22) Filed: Nov. 8, 2007

(51) Int. Cl.
*B63B 17/02* (2006.01)
*B63B 17/00* (2006.01)

(52) U.S. Cl. ..... 114/361; 114/353

(58) Field of Classification Search ..... 114/361
See application file for complete search history.

(56) References Cited

U.S. PATENT DOCUMENTS 6,854,413 B2 2/2005 Jackson et al.
6,983,716 B1 * 1/2006 Ankney et al. ..... 114/361
7,334,956 B2 * 2/2008 Taylor ..... 403/87
7,418,918 B2 * 9/2008 Bierbower et al. ..... 114/361

* cited by examiner

*Primary Examiner*—Jesus D Sotelo
(74) *Attorney, Agent, or Firm*—Larson & Larson; Frank Liebenow

(57) ABSTRACT

An application for a boat tower load relief system includes a boat tower support post connected to a receptacle for the boat tower support post by a hinge. The boat tower load relief system includes a torsion spring with a first end, a first winding, a central bend, a second winding and a second end. The central bend pushes on a boat tower support post section of the hinge and the first end and the second end of the torsion spring push on a support plate which is attached to the receptacle for the boat tower post.

17 Claims, 6 Drawing Sheets

LOAD RELIEF MECHANISM FOR FISHING BOAT TOWER

FIELD OF THE INVENTION

This invention relates to the field of fishing boats and more particularly to a load relief mechanism to facilitate the folding and restoring of a foldable fishing boat tower.

BACKGROUND OF THE INVENTION

Many fishing boats have tower structures raising high above the boat deck to improve visibility into the water during the task of finding fish. Often, these towers raise 20 to 30 feet above the boat deck. When in use, these towers improve the distance vision and water depth vision of the operator.

When the boat is being trailered, these towers often cause problems due to their height. The height of the tower, boat and trailer often reach 20 to 40 feet, making it difficult or impossible to travel beneath power lines, bridges, etc.

To combat this problem, some boat manufacturers such as Gause Built Boats (www.gausebuiltboats.com) have made it so the top section of the tower folds, reducing the height of the boat on a trailer by six to 10 feet. Unfortunately, moving the top section of the tower into the folded position is awkward and often requires two strong people to make sure it doesn't drop suddenly. Likewise, restoring the top section of the tower to its operating position is even harder due to the weight of the top section of the tower. This task often requires at least two strong people to perform. Folding boat towers are well known. For example, U.S. Pat. No. 6,854,413 to Jackson, et al., describes an apparatus for folding a boat tower.

What is needed is an apparatus that will reduce the work required to fold the tower as well as assist in restoring the tower to its upright position.

SUMMARY OF THE INVENTION

In one embodiment, a boat tower load relief system is disclosed including a resilient member for relieving a load from a folding boat tower, the folding boat tower having a tower support post connected to a receptacle for the tower support post by a hinge. The resilient member has a mechanism for pushing the support post of the folding boat tower towards an in-use position. The mechanism for pushing interfaces between the tower support post and the receptacle for the tower support post.

In another embodiment, a boat tower load relief system is disclosed including a boat tower support post connected to a receptacle for the boat tower support post by a hinge. The boat tower load relief system includes a torsion spring with a first end, a first winding, a central bend, a second winding and a second end. The central bend pushes on a boat tower support post section of the hinge and the first end and the second end of the torsion spring push on a support plate which is attached to the receptacle for the boat tower post.

In another embodiment, a boat tower load relief system is disclosed including a left boat tower support post connected to a left receptacle for the left boat tower support post by a left hinge and a right boat tower support post connected to a receptacle for the right boat tower support post by a right hinge. The boat tower load relief system includes a left torsion spring with a first end, a first winding, a central bend, a second winding and a second end. The central bend pushes on a left boat tower support post section of the left hinge and the first end and the second end of the left torsion spring push on a left support plate which is attached to the left receptacle for the left boat tower post. A first bobbin supports the first winding of the left torsion spring and a second bobbin supports the second winding of the left torsion spring and a left shaft passes through and supports the first bobbin, passes through the left hinge and passes through the second bobbin, forming a left hinge pin of the left hinge. A support bracket slideably interfaces the first end and the second end of the left torsion spring to the left receptacle for the left boat tower support post. For the right support post, there is a right torsion spring with a first end, a first winding, a central bend, a second winding and a second end. The central bend pushes on a right boat tower support post section of the right hinge and the first end and the second end of the right torsion spring push on a right support plate which is attached to the right receptacle for the right boat tower post. A first right bobbin supports the first winding of the right torsion spring, a second right bobbin supports the second winding of the right torsion spring and a right shaft passes through and supports the first right bobbin, passes through the right hinge and passes through the second right bobbin; forming a right hinge pin of the right hinge. A support bracket slideably interfaces the first end and the second end of the right torsion spring to the right receptacle for the right boat tower support post.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
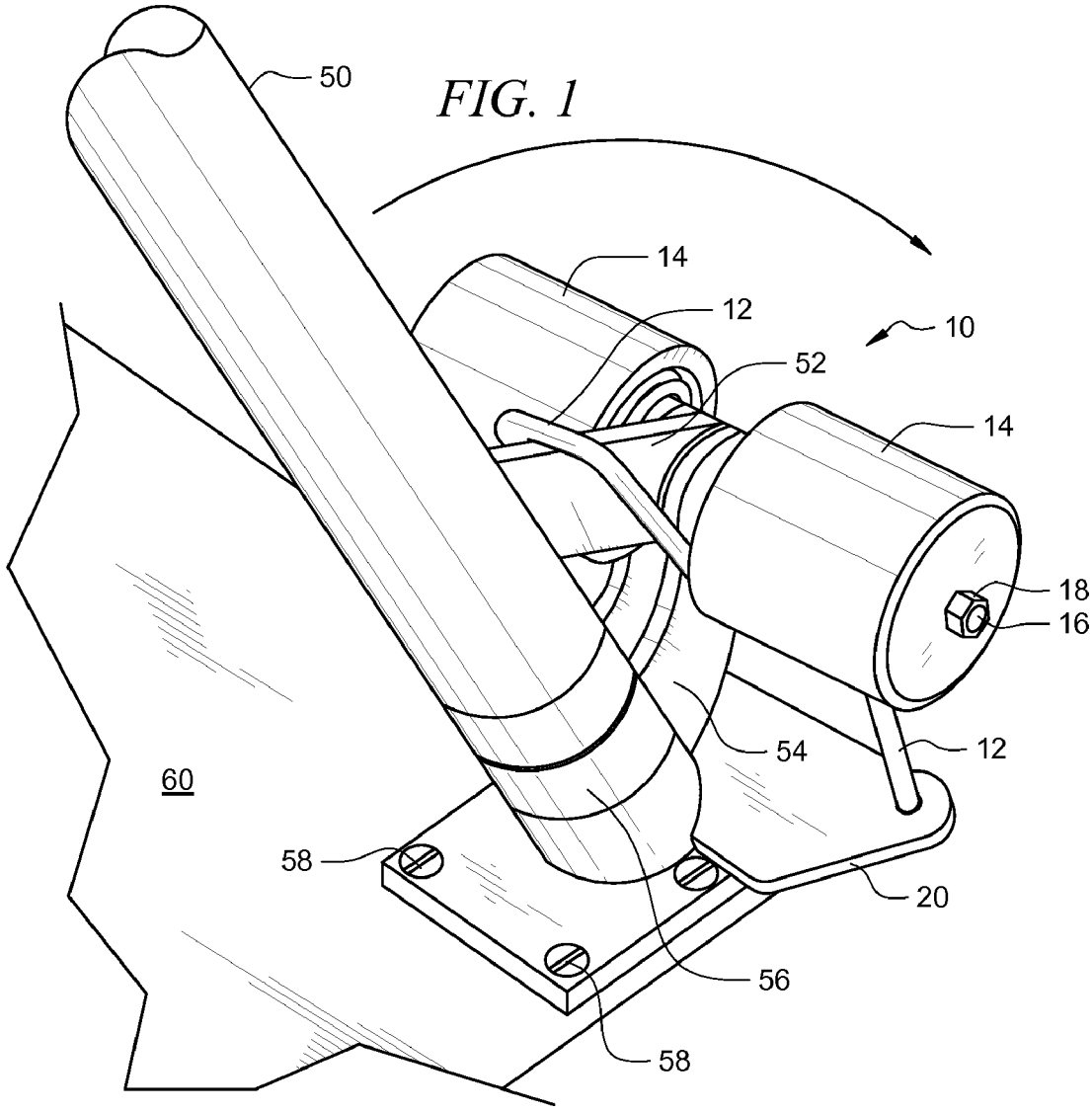
FIG. 1 illustrates an elevational view of a system of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an elevational view of a system of the present invention is shown. The load relief system 10 includes a heavy-duty spring 12 that is loaded when the tower is folded and releases energy when the tower is restored to its in-use position. It is preferred that the heavy-duty spring 12 be a double-wound torsion spring. The double wound torsion spring has an end, a winding, a mid-loop, another winding and a second end. Other types and configurations of springs are anticipated.

In FIG. 1, the tower support post 50 is shown in its in-use position, mated with a tower support post receptacle 56 which is secured to the center console roof 60 (or boat hull, etc.) by fasteners such as screws 58. Current art includes a hinge 52/54 for folding the tower support post 50. One section of the hinge 52 is attached to the tower support post 50 by means known in the industry such as welding and the other section of the hinge 54 is attached to the tower support post receptacle 56, also by means known in the industry such as welding. Instead of a simple hinge pin connecting the sections 52/54 of the hinge as previously known, the present invention replaces the hinge pin with a shaft 16 that is long enough to support the load relief spring assembly as will be shown in FIG. 3. The shaft 16 is held in place at each end with two nuts 18 (only one nut 18 is visible) or other fasteners as known in the industry such as cotter pins, etc. A center bend of the spring 12 is held against the top hinge section 52 by the load force on the spring. The ends of the spring 12 are held in position by a support plate 20 that is affixed to the tower support post receptor 56 by means known in the industry including welding, etc. Because the ends of the spring 12 retract slightly as the tower is folded, it is preferred that the ends of the spring 12 pass freely through the support plate 20 and that the spring 12 is long enough that the ends of the spring 12 extend far enough beyond the support plate 20, so as to not fall out of the support plate 20 when the tower is folded. In some embodiments, the winding portion of the spring 12 is covered with a cover 14 for aesthetic and safety reasons.

Figure 2:
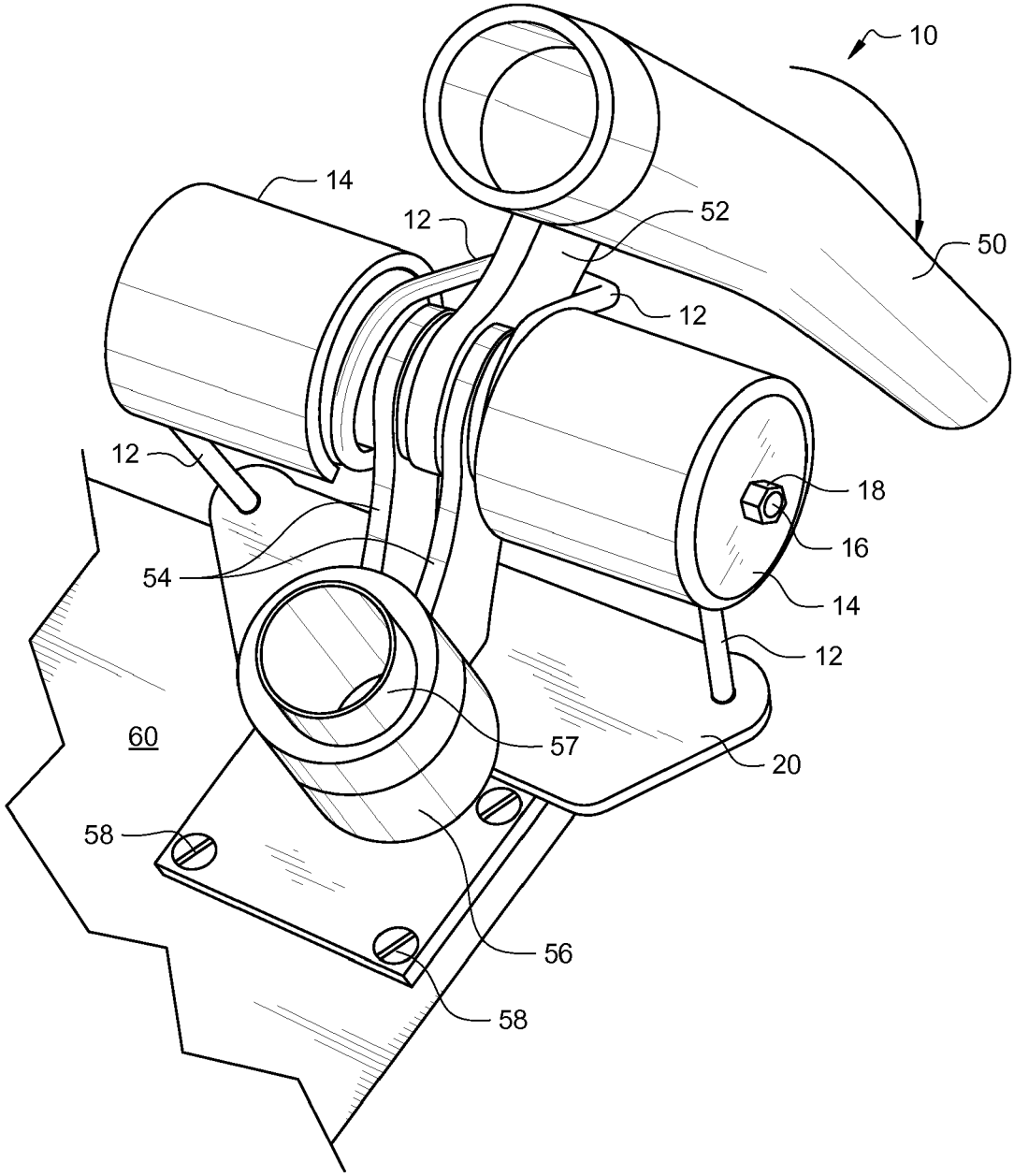
FIG. 2 illustrates an elevational view of a system of the present invention with the tower support post folded.

Referring to FIG. 2, an elevational view of a system of the present invention with the tower support post folded is shown. The load relief system 10 includes a heavy-duty spring 12 that is shown loaded and the tower folded. The tower support post 50 is shown in its folded position, ready to mate with a tower support post receptacle 56 which is secured to the center console roof 60 (or boat hull, etc.) by fasteners such as screws 58. In some embodiments of the tower support post system, a mating guide 57 is included to assure proper mating of the tower support post 50 with the tower support post receptacle 56 and to protect any electrical wires or other cables that pass within the tower support post 50. Again, current art includes a hinge 52/54 for folding the tower support post 50. One section of the hinge 52 is attached to the tower support post 50 by means known in the industry such as welding and the other section of the hinge 54 is attached to the tower support post receptacle 56, also by means known in the industry such as welding. A shaft 16 passes through the load relief system 10 and is long enough to support the load relief spring assembly as will be shown in FIG. 3. The shaft 16 is held in place at each end with two nuts 18 (only one nut 18 is visible) or other fasteners as known in the industry such as cotter pins, etc. A center bend of the spring 12 is held against the top hinge section 52 by the load force on the spring. The ends of the spring 12 are held in position by a support plate 20 that is affixed to the tower support post receptor 56 by means known in the industry including welding, etc. Because the ends of the spring 12 retract slightly as the tower is folded, it is preferred that the ends of the spring 12 pass freely through the support plate 20 and that the spring 12 is long enough that the ends of the spring 12 extend far enough beyond the support plate 20, so as to not fall out of the support plate 20 when the tower is folded. In some embodiments, the winding portion of the spring 12 is covered with a cover 14 for aesthetic and safety reasons.

Figure 3:
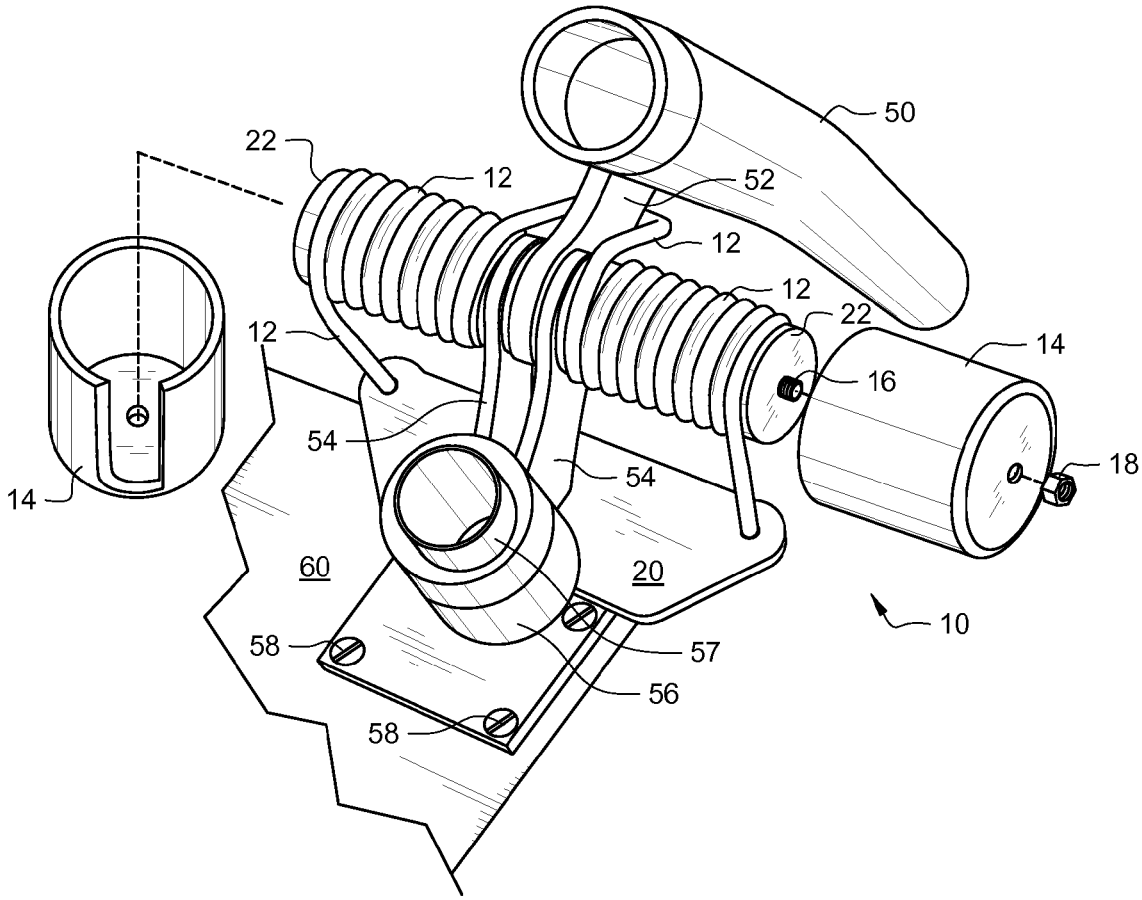
FIG. 3 illustrates an exploded view of the present invention.

Referring to FIG. 3, an exploded view of the present invention is shown. The load relief system 10 includes a heavy-duty spring 12 that is shown loaded and the tower folded. In the preferred embodiment, a bobbin 22 runs the length of the winding section of the spring 12 to force the spring 12 to wind evenly when it is compressed. Although the bobbin 22 is made from any resilient, hard material, it is preferred to use a sturdy, low-friction plastic such as nylon. The bobbins are held in place by a shaft and the shaft also serves as the hinge pin for the hinge 52/54.

The tower support post 50 is shown in its folded position, ready to mate with a tower support post receptacle 56 which is secured to the center console roof 60 (or boat hull, etc.) by fasteners such as screws 58. In some embodiments of the tower support post system, a mating guide 57 is included to assure proper mating of the tower support post 50 with the tower support post receptacle 56 and to protect any electrical wires or other cables that pass within the tower support post 50. Again, current art includes a hinge 52/54 for folding the tower support post 50. One section of the hinge 52 is attached to the tower support post 50 by means known in the industry such as welding and the other section of the hinge 54 is attached to the tower support post receptacle 56, also by means known in the industry such as welding. In current art, one section of the hinge 54 has two prongs and the other section of the hinge 52 has a single prong. It is anticipated that other configurations are possible such as the two prong hinge section 54 attached to the tower support post 50, both hinges sections having only one prong or both having multiple prongs.

A shaft 16 passes through the load relief system 10 and supports the load relief spring assembly including the bobbin 22 and the cover 14. The shaft 16 is held in place at each end with two nuts 18 (only one nut 18 is visible) or other fasteners as known in the industry such as cotter pins, etc. In some embodiments, one end of the shaft is enlarged as the tightening end of a bolt or screw and only one fastener is needed.

A center bend of the spring 12 is held against the top hinge section 52 by the load force on the spring. The ends of the spring 12 are held in position by a support plate 20 that is affixed to the tower support post receptor 56 by means known in the industry including welding, etc. Because the ends of the spring 12 retract slightly as the tower is folded, it is preferred that the ends of the spring 12 pass freely (slideably) through the support plate 20 and that the spring 12 is long enough that the ends of the spring 12 extend far enough beyond the support plate 20, so as to not fall out of the support plate 20 when the tower is folded. In some embodiments, the winding portions of the spring 12 are covered with covers 14 for aesthetic and safety reasons.

Figure 4:
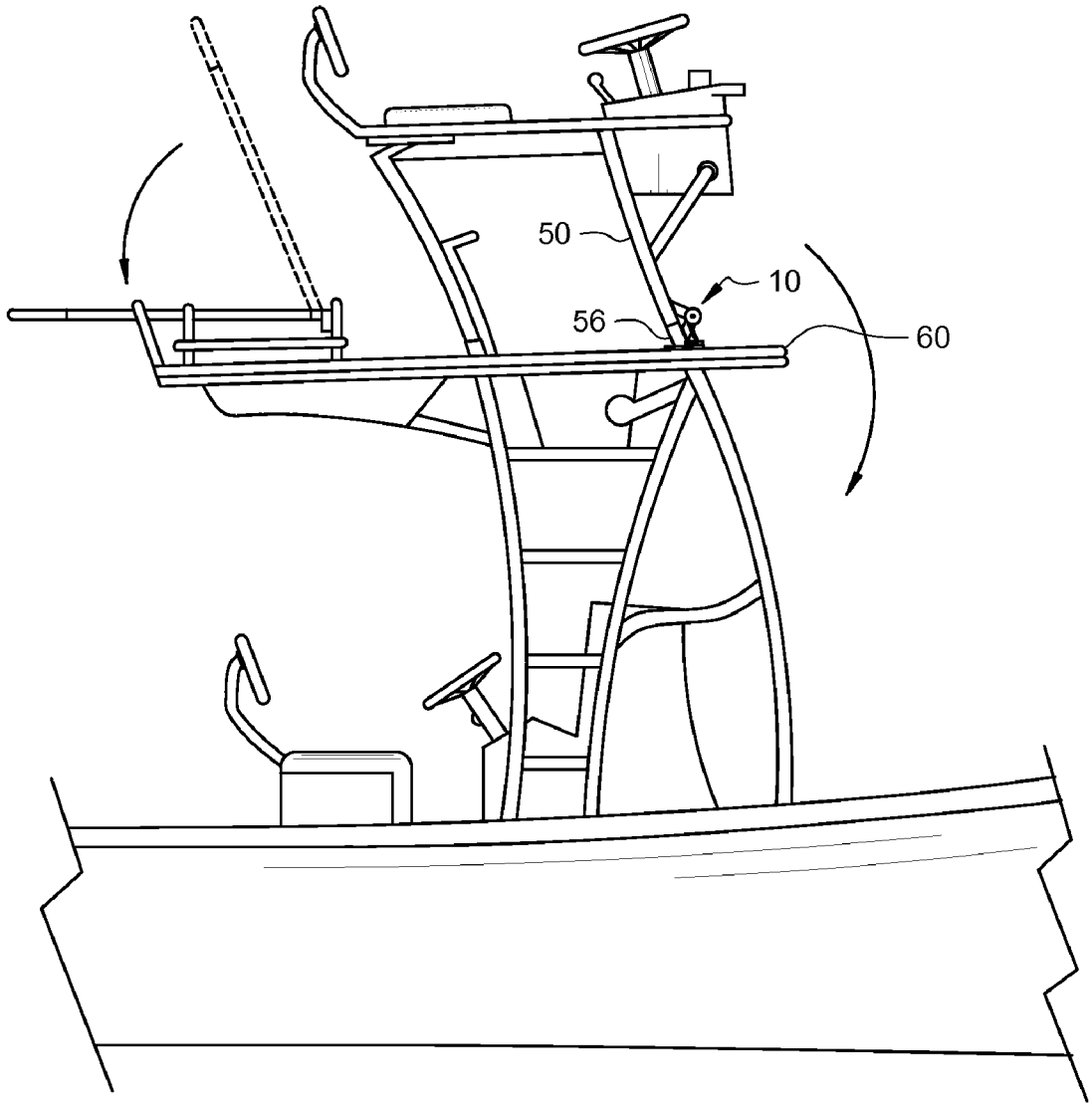
FIGS. 4-6 illustrates a plan view of the present invention installed on a boat tower at various degrees of folding.
Figure 5:
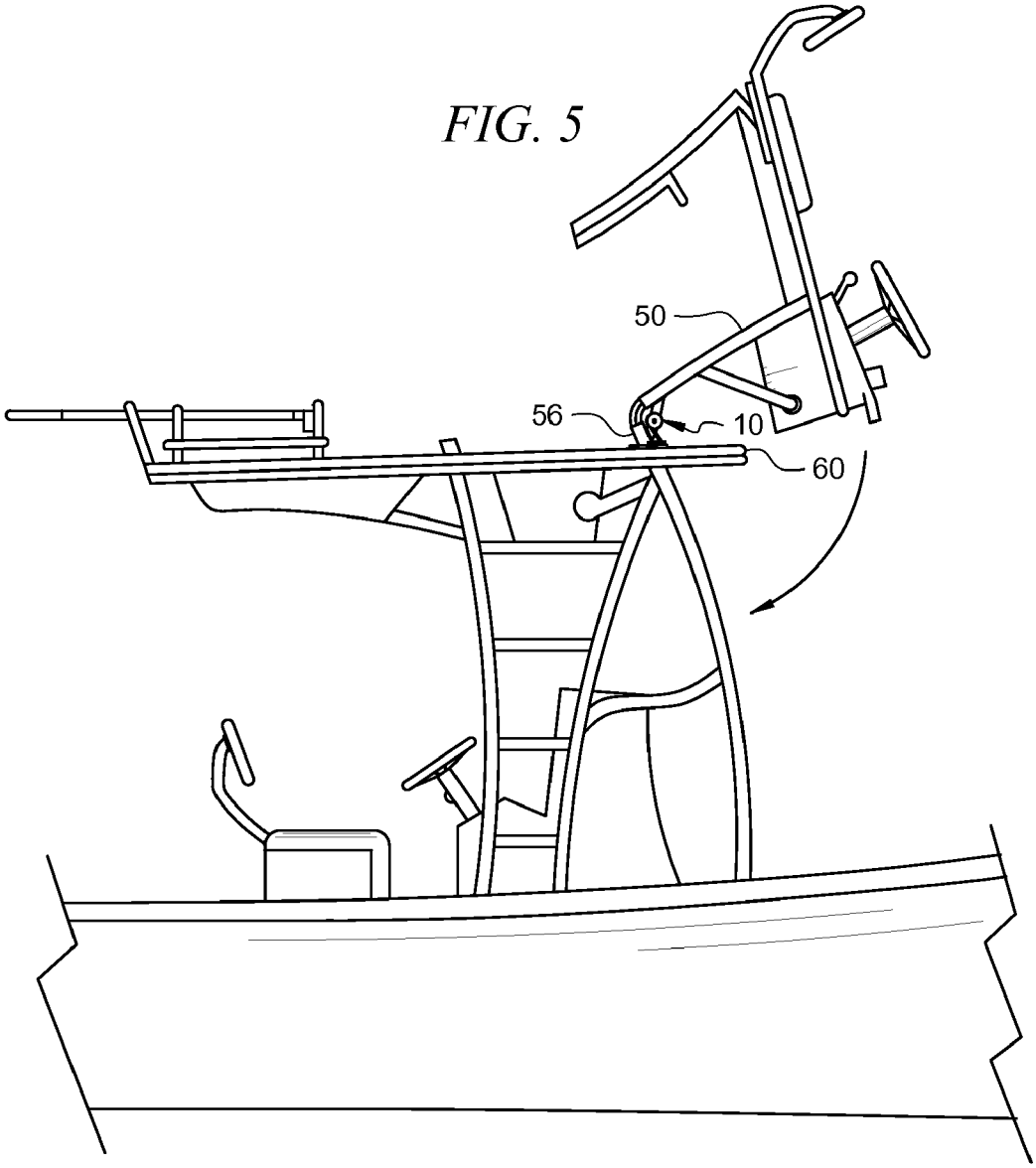
Figure 6:
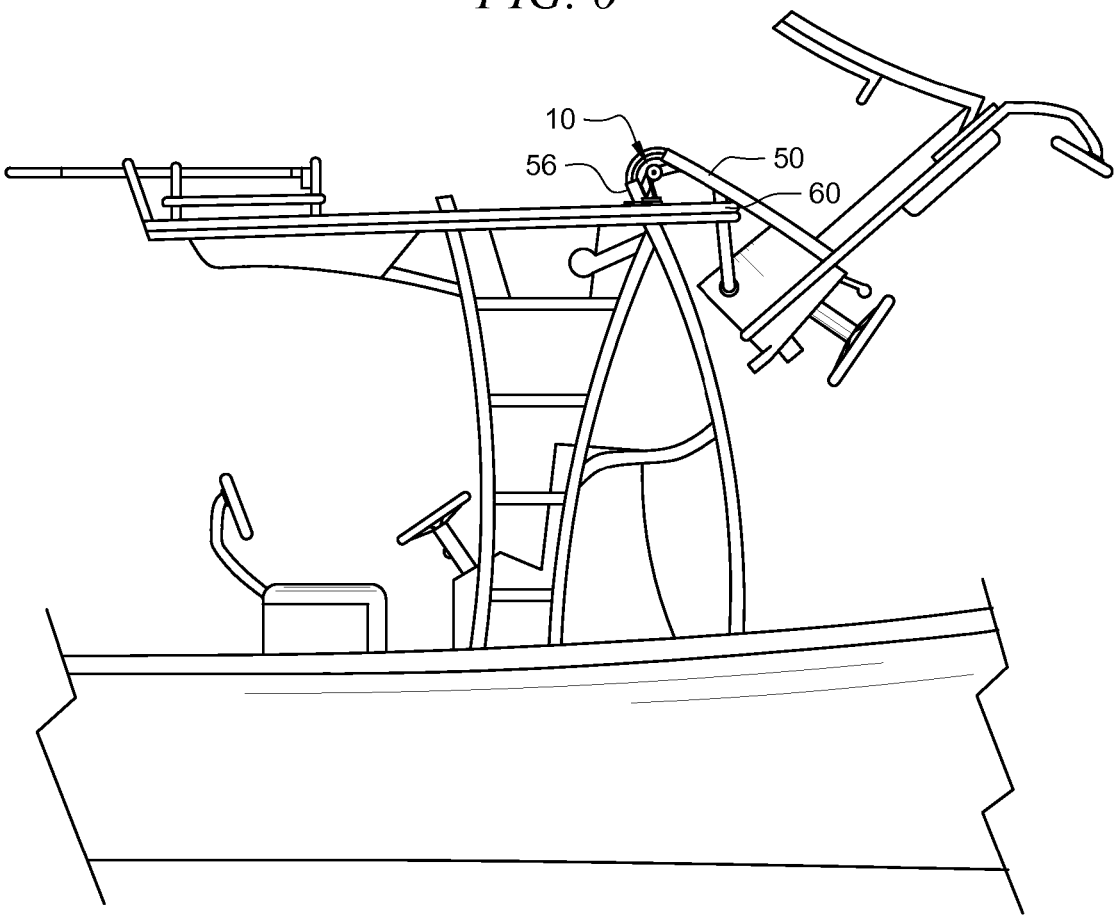

Referring to FIGS. 4-6, a plan view of the present invention installed on a boat tower at various degrees of folding is shown. It is preferred that a load relief system 10 of the present invention be mounted on both tower supports 50. FIG. 4 shows the tower in the in-use position. In this exemplary boat tower system, the tower folds forward as shown. In FIG. 5, the tower is shown partially folded. Before the present invention, it would be difficult for one person to maneuver the tower when it is in this transitional position, both keeping it from falling when folding the tower and pushing it up when restoring the tower to the in-use position. FIG. 6 shows the tower in its completely folded position. The spring 12 is now fully loaded and will exert force to help restore the tower to the in-use position.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A boat tower load relief system comprising:

a resilient member for relieving a load from a folding boat tower, the folding boat tower having a tower support post hingedly connected to a receptacle for the tower support post by a hinge;

the resilient member having means for pushing the support post of the folding boat tower towards an in-use position;

the means for pushing interfacing between the tower support post and the receptacle for the tower support post.

2. The boat tower load relief system of claim 1, wherein one of the means for pushing includes a torsion spring.

3. The boat tower load relief system of claim 2, wherein the torsion spring has a central bend and first winding and a second winding, the first winding on a first side of the central bend and the second winding on a distal side of the central bend and each winding having a spring end extending outwardly.

4. The boat tower load relief system of claim 3, wherein the central bend interfaces with a section of the hinge attached to the tower support post and the spring ends pass through a support bracket, the support bracket attached to the receptacle for tower support post.

5. The boat tower load relief system of claim 3, further comprising a first cover substantially covering the first winding of the torsion spring and a second cover substantially covering the second winding of the torsion spring.

6. The boat tower load relief system of claim 5, further comprising a first bobbin positioned within the first winding of the torsion spring and a second bobbin positioned within the second winding of the torsion spring, the bobbins held in place by a shaft, the shaft passing through the first cover, the first bobbin, the hinge, the second bobbin and the second cover, the shaft forming a hinge pin for the hinge.

7. A boat tower load relief system, the boat tower including a boat tower support post hingedly connected to a receptacle for the boat tower support post by a hinge, the boat tower load relief system comprising:

a torsion spring having a first end, a first winding, a central bend, a second winding and a second end, whereas the central bend pushes on a boat tower support post section of the hinge and the first end and the second end of the torsion spring push on a support plate, the support plate attached to the receptacle for the boat tower post.

8. The boat tower load relief system of claim 7, further comprising a shaft, the shaft passing through the first winding, through the hinge and through the second winding.

9. The boat tower load relief system of claim 8, wherein the shaft is a hinge pin for the hinge.

10. The boat tower load relief system of claim 7, further comprising a first bobbin and a second bobbin; the first bobbin mounted on the shaft and supporting the first winding;

the second bobbin mounted on the shaft and supporting the second winding.

11. The boat tower load relief system of claim 10, further comprising a first cover and a second cover, the shaft passing through and holding the first cover in place, the first cover substantially covering the first winding, the shaft passing through and holding the second cover in place, the second cover substantially covering the second winding.

12. The boat tower load relief system of claim 11, wherein the shaft is held in place by at least one fastener.

13. A boat tower load relief system, the boat tower comprising a left boat tower support post hingedly connected to a left receptacle for the left boat tower support post by a left hinge and a right boat tower support post hingedly connected to a receptacle for the right boat tower support post by a right hinge, the boat tower load relief system comprising:

a left torsion spring having a first end, a first winding, a central bend, a second winding and a second end, whereas the central bend pushes on a left boat tower support post section of the left hinge and the first end and the second end of the left torsion spring push on a left support plate, the left support plate attached to the left receptacle for the left boat tower post;

a first bobbin for supporting the first winding of the left torsion spring;

a second bobbin for supporting the second winding of the left torsion spring;

a left shaft passing through and supporting the first bobbin and passing through the left hinge and passing through the second bobbin, the left shaft forming a left hinge pin of the left hinge;

a support bracket slideably interfacing the first end and the second end of the left torsion spring to the left receptacle for the left boat tower support post;

a right torsion spring having a first end, a first winding, a central bend, a second winding and a second end, whereas the central bend pushes on a right boat tower support post section of the right hinge and the first end and the second end of the right torsion spring push on a right support plate, the right support plate attached to the right receptacle for the right boat tower post;

a first right bobbin for supporting the first winding of the right torsion spring;

a second right bobbin for supporting the second winding of the right torsion spring;

a right shaft passing through and supporting the first right bobbin and passing through the right hinge and passing through the second right bobbin, the right shaft forming a right hinge pin of the right hinge; and a support bracket slideably interfacing the first end and the second end of the right torsion spring to the right receptacle for the right boat tower support post.

14. The boat tower load relief system of claim 13, further comprising a first left cover substantially covering the first winding of the left torsion spring and a second left cover substantially covering the second winding of the left torsion spring, the covers held in place by the left shaft.

15. The boat tower load relief system of claim 13, further comprising a first right cover substantially covering the first winding of the right torsion spring and a second right cover substantially covering the second winding of the right torsion spring, the covers held in place by the right shaft.

16. The boat tower load relief system of claim 14, further comprising at least one fastener affixed to an end of the left shaft, holding the left shaft in place within the left hinge, left bobbins and left covers.

17. The boat tower load relief system of claim 14, further comprising at least one fastener affixed to an end of the right shaft, holding the right shaft in place within the right hinge, right bobbins and right covers.

* * * * *